US011498073B2

(12) United States Patent
Zhao et al.

(10) Patent No.: US 11,498,073 B2
(45) Date of Patent: Nov. 15, 2022

(54) DIGITAL MICROFLUIDIC CHIP, METHOD FOR DRIVING THE SAME, AND DIGITAL MICROFLUIDIC DEVICE

(71) Applicants: Beijing BOE Optoelectronics Technology Co., Ltd., Beijing (CN); BOE TECHNOLOGY GROUP CO., LTD., Beijing (CN)

(72) Inventors: Wei Zhao, Beijing (CN); Chunlei Wang, Beijing (CN); Kun Jiang, Beijing (CN); Na Li, Beijing (CN); Xuechao Song, Beijing (CN); Lin Han, Beijing (CN); Lanjun Guo, Beijing (CN); Shaowu Ma, Beijing (CN); Kangdi Zhou, Beijing (CN); Jinshuai Duan, Beijing (CN); Xianping Luo, Beijing (CN)

(73) Assignees: BEIJING BOE OPTOELECTRONICS TECHNOLOGY CO., LTD., Beijing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 288 days.

(21) Appl. No.: 16/641,756

(22) PCT Filed: Jun. 27, 2019

(86) PCT No.: PCT/CN2019/093240

§ 371 (c)(1),
(2) Date: Feb. 25, 2020

(87) PCT Pub. No.: WO2020/001528

PCT Pub. Date: Jan. 2, 2020

(65) Prior Publication Data

US 2020/0391213 A1 Dec. 17, 2020

(30) Foreign Application Priority Data

Jun. 28, 2018 (CN) ..... 201810690544.3

(51) Int. Cl.
*B01L 3/00* (2006.01)

(52) U.S. Cl.
CPC ..... *B01L 3/502792* (2013.01); *B01L 2200/10* (2013.01); *B01L 2300/161* (2013.01);
(Continued)

(58) Field of Classification Search
CPC ..... B01L 2300/161; B01L 3/502792
See application file for complete search history.

(56) References Cited

U.S. PATENT DOCUMENTS 7,726,832 B2 6/2010 Clark
2007/0052023 A1 3/2007 Yang et al.
(Continued)

FOREIGN PATENT DOCUMENTS

CN 103041877 A 4/2013
CN 103084228 A 5/2013
(Continued)

OTHER PUBLICATIONS

Chiou, Pei-Yu et al. "Droplet Manipulation With Light on Optoelectrowetting Device." J Microelectromechanical Systems (2008) 17 133-138. (Year: 2008).*
(Continued)

*Primary Examiner* — Christopher Adam Hixson
(74) *Attorney, Agent, or Firm* — Myers Bigel, P.A.

(57) ABSTRACT

A digital microfluidic chip, a method for driving the same, and a digital microfluidic device are provided. The digital microfluidic chip includes a state transition layer configured to bear a droplet, and a light driving layer configured to provide light for controlling a lyophobicity-lyophobicity transition of the state transition layer to drive the droplet to move. The light driving layer includes light emitting units arranged in an array and provides light. The state transition layer realizes a lyophobicity-lyophobicity transition. The
(Continued)

light driving layer controls the lyophobicity-lyophobicity transition by providing light to drive the droplet to move. An existing digital microfluidic chip has a complex structure and a high fabricating cost, while the digital microfluidic chip of the present disclosure has a simple structure, a simple fabricating process and a low fabricating cost, and can realize miniaturization and integration to a maximum extent.

16 Claims, 3 Drawing Sheets

(52) U.S. Cl.
CPC ..... *B01L 2300/1883* (2013.01); *B01L 2400/0493* (2013.01)

(56) References Cited

U.S. PATENT DOCUMENTS

| | | | | |
|---|---|---|---|---|
| 2019/0099756 | A1 | 4/2019 | Pang et al. | |
| 2019/0105655 | A1 | 4/2019 | Dong et al. | |
| 2019/0232278 | A1* | 8/2019 | Yu ..... | C08G 61/08 |

FOREIGN PATENT DOCUMENTS

| | | | |
|---|---|---|---|
| CN | 107497509 | A | 12/2017 |
| CN | 107676541 | A | 2/2018 |
| CN | 107971049 | A | 5/2018 |
| CN | 108620143 | A | 10/2018 |
| CN | 109078661 | A | 12/2018 |
| KR | 10-0892905 | B1 | 4/2009 |

OTHER PUBLICATIONS

Lien, Victor et al. "A Prealigned Process of Integrating Optical Waveguides With Microfluidic Devices." IEEE Photonics Technology Letters (2004) 16 1525-1527. (Year: 2004).*

Translation of CN 103041877A, as provided by Google Patents on Jun. 29, 2022. (Year: 2022).*

First Office Action and English language translation, CN Application No. 201810690544.3, dated Jul. 9, 2019, 17 pp.

Second Office Action and English language translation, CN Application No. 201810690544.3, dated Dec. 6, 2019, 11 pp.

Zhang et al., "Light and Thermal-Stimuli Responsive Materials" (with English language translation), Progress in Chemistry, vol. 20, No. 5, May 2008, pp. 657-672 (57 pp. total with English language translation).

* cited by examiner

DIGITAL MICROFLUIDIC CHIP, METHOD FOR DRIVING THE SAME, AND DIGITAL MICROFLUIDIC DEVICE

RELATED APPLICATIONS

The present application is a 35 U.S.C. 371 national stage application of PCT International Application No. PCT/CN2019/093240, filed on Jun. 27, 2019, which claims the benefit of Chinese Patent Application No. 201810690544.3, filed on Jun. 28, 2018, the entire disclosures of which are incorporated herein by reference.

TECHNICAL FIELD

The present disclosure relates to the field of microfluidic technologies, and particularly to a digital microfluidic chip, a method for driving the same, and a digital microfluidic device.

BACKGROUND

With the development of micro electro mechanical techniques, the digital microfluidic technique has made a breakthrough in driving and controlling of a micro-droplet, and has been widely applied in biological, chemical and medical fields due to its own advantages. The digital microfluidic technique is an emerging inter-discipline in which chemistry, fluid physics, microelectronics, novel materials, biology, and biomedical engineering are involved. Due to features of miniaturization and integration, a device which adopts the microfluidic techniques is usually referred to as a digital microfluidic chip. Various samples like cells can be cultured, moved, detected, and analyzed in the digital microfluidic chip. From the wide applications in various fields, it can be seen that the digital microfluidic chip has advantages of small volume, small reagent dosage, fast reaction, portability, parallel processing, and automation. Besides, the digital microfluidic chip has great development potential and wide application prospects.

SUMMARY

Embodiments of the present disclosure provide a digital microfluidic chip, comprising a state transition layer configured to bear a droplet; and a light driving layer configured to provide light for controlling a lyophobicity-lyophobicity transition of the state transition layer so as to drive the droplet to move In one or more embodiments, the state transition layer comprises a photosensitive material in which a lyophobic cis-structure is transitioned into a lyophilic trans-structure upon irradiation by light.

In one or more embodiments, the photosensitive material comprises a copolymer of isopropylacrylamide and acryloxysuccinimide.

In one or more embodiments, the digital microfluidic chip further comprises a base plate, wherein the light driving layer is arranged on the base plate, and the state transition layer is stacked on the light driving layer.

In one or more embodiments, the droplet is beared on a surface of the state transition layer away from the base plate.

In one or more embodiments, the light driving layer is spaced apart from the state transition layer, and a space for bearing the droplet is formed between the light driving layer and the state transition layer.

In one or more embodiments, the state transition layer comprises a first state transition layer and a second state transition layer which are spaced apart from each other, and a space for bearing the droplet is formed between the first state transition layer and the second state transition layer.

In one or more embodiments, the digital microfluidic chip further comprises a detect circuit configured to detect a position of the droplet; and a control circuit configured to generate a control signal according to the position of the droplet and a preset movement direction and/or speed of the droplet, and send the control signal to the light driving layer, wherein the control signal comprises a position to which light is required to be provided and an intensity of the provided light.

In one or more embodiments, the light driving layer comprises a plurality of light emitting units which are arranged in an array.

In one or more embodiments, the control circuit is configured to determine first light emitting units from the plurality of light emitting units according to the position of the droplet, determine second light emitting units from the plurality of light emitting units which are required to provide light according to the preset movement direction of the droplet, and determine the intensity of light provided by the second light emitting units according to the preset movement speed of the droplet.

In one or more embodiments, the photosensitive material has a lyophilic degree in direct proportion to the intensity of light provided by the light driving layer.

In one or more embodiments, the digital microfluidic chip further comprises a thermal control layer configured to control the temperature of the state transition layer.

In one or more embodiments, the thermal control layer is arranged between the light driving layer and the state transition layer.

In one or more embodiments, the state transition layer is transitioned from lyophobicity to lyophilicity during the lyophobicity-lyophobicity transition.

In one or more embodiments, each of the plurality of light emitting units is a micro-LED.

Embodiments of the present disclosure further provide a digital microfluidic device, comprising the digital microfluidic chip as described above.

Embodiment of the present disclosure further provide a driving method for a digital microfluidic chip, wherein the digital microfluidic chip comprises a light driving layer and a state transition layer configured to bear the droplet, the driving method comprising:

as a response to a control signal, providing light for controlling a lyophobicity-lyophobicity transition of the state transition layer so as to drive the droplet to move by using the light driving layer.

In one or more embodiments, the driving method further comprises: detecting a position of the droplet; and generating the control signal according to the position of the droplet and the preset movement direction and speed of the droplet.

In one or more embodiments, the control signal comprises a position to which light is required to be provided and an intensity of the provided light.

In one or more embodiments, the light driving layer comprises a plurality of light emitting units which are arranged in an array, and generating the control signal comprises: determining first light emitting units from the plurality of light emitting units according to the position of the droplet, determining second light emitting units from the plurality of light emitting units to which light is required to be provided according to the preset movement direction of the droplet, determining the intensity of light provided by the second light emitting units according to the preset movement speed of the droplet, and generating the control signal comprising information about a position of the second light emitting units and information about the intensity of light provided by the second light emitting units.

BRIEF DESCRIPTION OF THE DRAWINGS

The accompanying drawings are used for providing further understanding of the present disclosure, and constitute a part of the specification. The accompanying drawings are used for explaining technical solutions of the present disclosure together with the following embodiments, but are not intended to limit the present disclosure. The shapes and sizes of components in the drawings are not drawn in a true scale, and only intend to illustrate the content of the present disclosure.

DETAILED DESCRIPTION OF EMBODIMENTS

The technical solutions of the embodiments in this disclosure are clearly and completely described in combination with the drawings. The following embodiments are used for explaining the present disclosure, but are not intended to limit the present disclosure. It is noted that without conflict, the embodiments and features of the embodiments in the present disclosure can be combined with one another.

Currently, a mainstream driving mode for the digital microfluidic chip is electrode driving, and the digital microfluidic chip is also referred to as a voltage-type digital microfluidic chip. The operation principle follows. A droplet is provided on a surface comprising a hydrophobic layer. A voltage is applied to the droplet, and the wettability between the droplet and the hydrophobic layer is increased by means of electrowetting effect. As a result, the droplet is subject to asymmetric deformation and an internal pressure difference is produced, so that the droplet is moved in a specified direction and mixed. In addition, the digital microfluidic chip can further be drove by dielectrophoresis, surface acoustic wave, electrostatic force, or the like. However, these driving manners suffer from various problems.

An existing digital microfluidic chip comprises a first substrate and a second substrate which are arranged oppositely. The first substrate comprises a first electrode, a dielectric layer and a hydrophobic layer which are formed on a base plate in this order. The second substrate comprises a second electrode, a dielectric layer and a hydrophobic layer which are formed on a base plate in this order. The structure is relatively complex. The fabricating process is also relatively complex. Usually electrode layers are formed by deposition, dielectric layers are formed by evaporation, and hydrophobic layers are formed by spin-coating and baking. Two or three masks are required. The fabricating cost is relatively high. Furthermore, the digital microfluidic chip of this construction is drove by electrode driving. A voltage is applied between the first electrode and the second electrode, and an electric field is generated between the first substrate and the second substrate, to change the hydrophobic or hydrophilic state of the droplet. Due to the relatively high operation voltage, active substance in the droplet, such as cells, DNA or proteins, may suffer from irreversible damage. Meanwhile, the digital microfluidic chip of an electrode driving has a complex structure and a relatively high fabricating cost.

It is the fact these technical issues have not been effectively solved that hinders the development of microfluidic technique.

Figure 1:
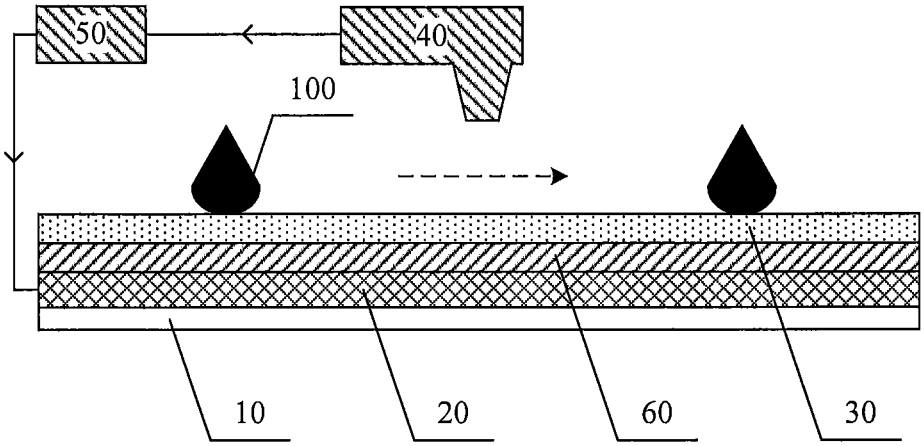
FIG. 1 is a structural view for illustrating a digital microfluidic chip in an embodiment of the present disclosure.

In order to overcome the defects of the existing digital microfluidic chip, such as irreversible damage to the active substance, complex structure, high fabricating cost, embodiments of the present disclosure there provide a digital microfluidic chip. FIG. 1 is a structural view for a digital microfluidic chip in an embodiment of the present disclosure. As shown in FIG. 1, the digital microfluidic chip in an embodiment of the present disclosure has a main structure comprising a light driving layer 20 and a state transition layer 30. The state transition layer 30 is configured to bear a droplet 100, and the light driving layer 20 is configured to provide light. The provided light controls the lyophobicity-lyophobicity transition of the state transition layer 30 so as to drive the droplet 100 to move. The lyophobicity-lyophobicity transition indicates the transition of the state transition layer 30 from lyophobicity to lyophilicity.

In particular, the light driving layer 20 comprises a plurality of light emitting units which are arranged in an array on a base plate 10. Each of the light emitting units can be addressed and controlled, and emits light of a given intensity by driving separately. In an embodiment, the light emitting unit can adopt a micro light-emitting diode (Micro LED), and a plurality of micro-LEDs form a micro-LED array. Currently, the micro-LED has been developed greatly, and can become thinner, miniaturized, and arranged in an array. The micro-LED has a dimension only of the order of 1~10 μm, and is very applicable to the digital microfluidic chip of the order of millimeters. As an embodiment, thee micro-LED comprises a first electrode and a second electrode which are arranged oppositely, and a light emitting functional layer between the first electrode and the second electrode. The light emitting functional layer comprises a P type semiconductor layer, an active layer, and an N type semiconductor layer. The operation principle follows. A forward bias is applied between the first electrode and the second electrode, so that when a current pass through the active layer, electron-hole pairs recombine in the active layer and emit monochromatic light. By controlling the voltage difference between the first electrode and the second electrode, the intensity of the emitted light can be controlled. The intensity of the emitted light by the micro-LED can be controlled in a range of 0-20000 nit. Each micro-LED can act as one light emitting unit. The plurality of light emitting units are arranged in a matrix to form a micro-LED array. In an embodiment of the present disclosure, the micro-LED array can adopt the existing construction and can be formed by a mature process, which is not repeated here for simplicity. The intensity of light emitted by each micro-LED can be controlled by active matrix driving, so that different light emitting units in the micro-LED array emits different intensities of light.

In an embodiment of the present disclosure, upon irradiation by light, the state transition layer 30 changes from a lyophobic cis-structure into a lyophilic trans-structure. By means of the transition from lyophobicity to lyophilic, the movement of the droplet on the state transition layer 30 can be controlled by the driving principle based on the wetting effect. The light of different intensities emitted by the plurality of light emitting units irradiates the state transition layer 30, so that a plurality of regions are formed in the state transition layer 30, and each of the regions has different lyophilic degree. As a result, the droplet on the state transition layer 30 may exhibit different wetting degrees, i.e., different solid-liquid contact angles, so that the droplet is provided with a drive force to move. Finally, it is realized that movement speed and movement direction of the droplet is controlled by the micro-LED array.

Figure 2:
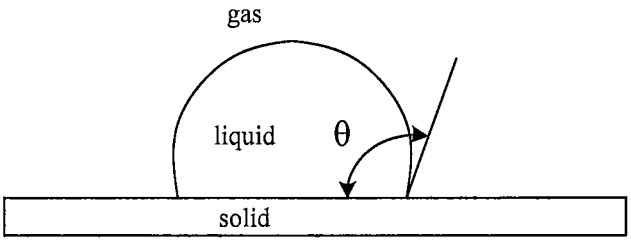
FIG. 2 is a schematic view for illustrating a contact angle of a droplet.

A surface wettability is one of the major properties of a solid surface. If a liquid is uniformly is dispersed on a surface without forming a droplet, it is believed that this surface essentially tends to be hydrophilic and allows water to disperse. In contrast, if water forms a droplet on a lyophobic surface, it is believed that this surface essentially tends to be hydrophobic. The wettability the solid surface is usually measured and determined by a contact angle. FIG. 2 is a schematic view for a contact angle of a droplet. As shown in FIG. 2, as for a liquid on a horizontal surface, the contact angle θ is a result of three different kinds of surface tension in the interface among solid, liquid and gas, and is expressed by Young's equation:

$$\cos\theta=(\gamma_{sol\text{-}gas}-\gamma_{sol\text{-}liq})/\gamma_{gas\text{-}liq},$$

wherein, $\gamma_{sol\text{-}gas}$, $\gamma_{sol\text{-}liq}$ and $\gamma_{gas\text{-}liq}$ are the surface tension coefficient of a solid gas interface, the surface tension coefficient of a solid liquid interface and the surface tension coefficient of a gas liquid interface, respectively. Based on Young's equation, lyophilicity indicates the contact angle of the droplet on the solid surface is smaller than 90°, while lyophobicity indicates the contact angle of the droplet on the solid surface is larger than 90°.

In an embodiment of the present disclosure, the state transition layer comprises a photosensitive material. In case the photosensitive material is irradiated by light at a temperature below a critical temperature, a lyophobic cis-structure in the photosensitive material is transitioned into a lyophilic trans-structure, so that the surface with which the droplet contacts changes from lyophobic into lyophilic. The photosensitive material is a type of a photo responsive hydrogel. A common photo-sensitive compound comprises chlorophyllin, dichromates, aromatic azide-compounds, aromatic diazo-compounds, aromatic nitro-compounds, organohalogen compounds. The photo-sensitive compound is decomposable by light, and is added to a polymer gel. Upon stimulation by light, a great number of ions are formed in the gel, and this introduces an abrupt change of the osmotic pressure inside the gel. As a result, the solvent is diffused from outside towards inside, and this prompts the volume phase transition of the gel to produce a photosensitive effect. When the intensity of light is absorbed to a critical point, a transition from cis-isomer to trans-isomer occurs in the molecular structure, realize lyophobicity-lyophobicity transition. In an embodiment, the photosensitive material layer comprises a copolymer of isopropylacrylamide and acryloxysuccinimide, and acryloxysuccinimide is boned at the side group to form aminopropoxy azobenzene. The structure imparts the copolymer with photosensitive property. When the azo group at the side chain is present as a stable hydrophobic cis-structure, upon irradiation with visible or UV light at a temperature below the critical temperature, the azo group changes into a hydrophilic trans-structure. When the temperature reaches the critical temperature (or higher than the critical temperature), upon irradiation with light for a second time, the azo group recovers into a hydrophobic cis-structure, so that the surface with which the droplet contacts changes from lyophilic to lyophobic. The lyophilic degree of the photosensitive material layer corresponds with the irradiation intensity. The higher the irradiation intensity is, the higher lyophilic degree the photosensitive material layer will have. The lower the irradiation intensity is, the lower lyophilic degree the photosensitive material layer will have. Thus, by controlling the irradiation intensity of the light emitting units in the micro-LED array, the lyophilic degree of a region of the photosensitive material layer corresponding with the respective light emitting unit can be changed. The light emitted by the light emitting units with different intensities irradiates the state transition layer, so that the state transition layer forms a plurality of regions, and these regions have different lyophilic degrees. Since different regions of the photosensitive material layer have different lyophilic degrees, when a droplet is dripped onto the photosensitive material layer, the droplet may exhibit different wetting degrees, i.e., different solid-liquid contact angles. According to the driving principle based on wetting effect, the droplet obtains the drive force to move, and finally it is realized to control the movement speed and movement direction of the droplet by light irradiation. In case the photosensitive material is a copolymer of isopropylacrylamide and acryloxysuccinimide, the critical temperature is about 40° C. The temperature below the critical temperature indicates a room temperature, e.g., 15° C.-30° C. In case the temperature is higher than about 40° C., the reverse reaction may occur. As for other photosensitive materials, the critical temperature may vary. Since the photosensitive material layer comprising a copolymer of isopropylacrylamide and acryloxysuccinimide is a commercially available product, the composition, characteristics, and fabricating process of the photosensitive material layer is well known for a person with ordinary skill in the art, which is not repeated herein for simplicity.

Figure 3A:
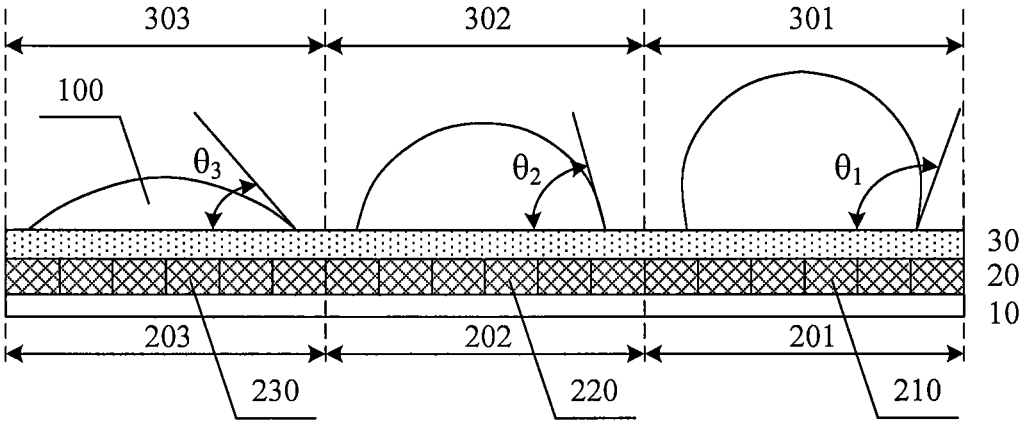
FIG. 3*a* and FIG. 3*b* are views for illustrating the principle of driving the droplet to move in an embodiment of the present disclosure.
Figure 3B:
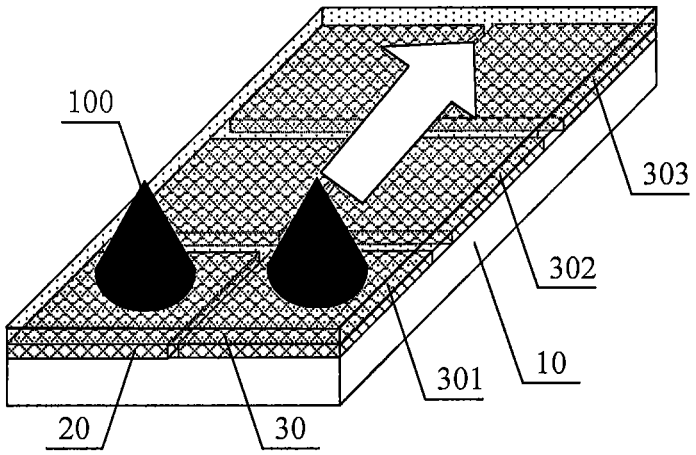

FIG. 3*a* and FIG. 3*b* are views for illustrating the principle of driving the droplet to move in an embodiment of the present disclosure. As shown in FIG. 3*a*, the light driving layer 20 comprises three light emitting regions: a first light emitting region 201, a second light emitting region 202, and a third light emitting region 203. Each of the first light emitting region 201, the second light emitting region 202 and the third light emitting region 203 comprises a plurality of light emitting units. For example, the first light emitting region 201 comprises a plurality of first light emitting units 210, the second light emitting region 202 comprises a plurality of second light emitting units 220, and the third light emitting region 203 comprises a plurality of third light emitting units 230. As described above, the first light emitting units 210, the second light emitting units 220 and the third light emitting units 230 for example are micro-LEDs.

The state transition layer 30 comprises state transition regions which correspond in position with these three light emitting regions, i.e., a first state transition region 301, a second state transition region 302 and a third state transition region 303. It is assumed that the irradiation intensity of the first light emitting region 201 to which the first state transition region 301 corresponds<the irradiation intensity of the second light emitting region 202 to which the second state transition region 302 corresponds<the irradiation intensity of the third light emitting region 203 to which the third state transition region 303 corresponds. As a result, the droplet may exhibit different wetting degrees, i.e., different solid-liquid contact angles. The lyophilic degree of the first state transition region 301<the lyophilic degree of the second state transition region 302<the lyophilic degree of the third state transition region 303. Namely, the lyophobic degree of the first state transition region 301>the lyophobic degree of the second state transition region 302>the lyophobic degree of the third state transition region 303. Thus, a contact angle $\theta_1$ of the first state transition region 301>a contact angle $\theta_2$ of the second state transition region 302>a contact angle $\theta_3$ of the third state transition region 303. Based on the physical property of the droplet, under drive by the internal pressure difference, the droplet may move in a direction from a region of a high lyophobic degree to a region of a low lyophobic degree. Namely, under drive by the internal pressure difference, the droplet in a poorly wetted region may move in a direction towards a well wetted region. Thus, when the droplet lies in the first state transition region 301, different portions of a same droplet have different solid-liquid contact angles, so that the surface tension is distributed asymmetrically, and there is a pressure difference inside the droplet. As a result, the droplet moves towards the second state transition region 302 under the drive of this internal pressure difference. In addition, when the droplet lies in the second state transition region 302, the droplet may be drove to move toward the third state transition region 303. By controlling an irradiation intensity difference between two neighboring light emitting regions, the variation gradient of contact angle between two neighboring state transition regions of the state transition layer can be controlled, and the movement speed of the droplet can thus be controlled. By controlling an irradiation intensity difference between two neighboring light emitting regions in a certain direction, the variation gradient of contact angle between two neighboring state transition regions of the state transition layer in a corresponding direction can be controlled, and the movement direction of the droplet can thus be controlled, as shown in FIG. 3*b*.

Usually, the droplet 100 has a dimension about a millimeter (mm), the micro-LEDs 210, 220, 230 have a dimension about a micrometer (μm), and one droplet may cover a plurality of micro-LEDs. Thus the light emitting region as described above can be understood as a region covered by the droplet.

In an embodiment of the present disclosure, a digital microfluidic chip further can comprise a detect circuit 40 and a control circuit 50, as shown in FIG. 1. The detect circuit 40 is configured to detect a position of the droplet 100. The control circuit 50 is configured to control the irradiation intensity of the light emitting units 210, 220, 230 on the light driving layer 20, according to the preset movement direction and/or speed of the droplet. In particular, after a position of the droplet 100 is detected by the detect circuit 40, information about the droplet position is sent to the control circuit 50. The plurality of first light emitting units 210 to which the droplet position corresponds are determined by the control circuit 50 according to information about the droplet position, the plurality of second light emitting units 220 which are adjacent with the plurality of first light emitting units 210 in the movement direction are then determined according to the preset movement direction of the droplet, and the irradiation intensity of the plurality of second light emitting units 220 are finally determined according to the preset movement speed of the droplet. During implementations, the control circuit 50 can adopt an addressing circuit well known in the art. The detect circuit 40 can operate in an impedance mode or a photoelectronic mode, and can obtain the droplet information by detection. The droplet information comprises parameters like the position, size, appearance and/or composition of the droplet. The detect circuit and the control circuit as described above have a structure and an arrangement manner on the digital microfluidic chip similar with the existing structure and arrangement manner, which are not repeated herein for simplicity. It is noted that FIG. 1 only shows the detect circuit and the control circuit in a schematic manner. The detect circuit 40 and the control circuit 50 can be arranged separately from the functional layers such as the light driving layer 20 and the state transition layer 30, or can be integrated on the base plate 10 along with these functional layers.

In another embodiment, a digital microfluidic chip of the present disclosure for example further comprises a thermal control layer 60, as shown in FIG. 1. The thermal control layer 60 is configured to control the temperature of the state transition layer. In one aspect, the transition of the state transition layer from the lyophobic cis-structure to the lyophilic trans-structure is enabled below the critical temperature. In another aspect, the transition from the lyophilic trans-structure to the lyophobic cis-structure of the state transition layer is enabled at the critical temperature or a higher temperature. During implementations, the thermal control layer 60 can comprises a semiconductor refrigerating material (thermoelectric refrigerating material). According to the Peltier effect, when a direct current passes through a thermocouple comprising two different semiconductor materials which are connected in series, thermocouple can absorb heat at one end and release heat at the other end, so as to realize heating and cooling. The structure of the thermal control layer and its arrangement on the digital microfluidic chip can be designed as needed. For example, the thermal control layer can be arranged between the light driving layer and the state transition layer, thus facilitating heating or cooling the state transition layer by the thermal control layer and thus controlling the temperature of the state transition layer.

As an embodiment, a digital microfluidic chip in an embodiment of the present disclosure can be designed to have the structure shown in FIG. 1. The light driving layer 20 is arranged on the base plate 10, the state transition layer 30 is arranged on the light driving layer 20. The droplet 100 is beared on a surface of the state transition layer 30 away from the base plate 10. In this way, a single-substrate digital microfluidic chip structure is formed.

Figure 4A:
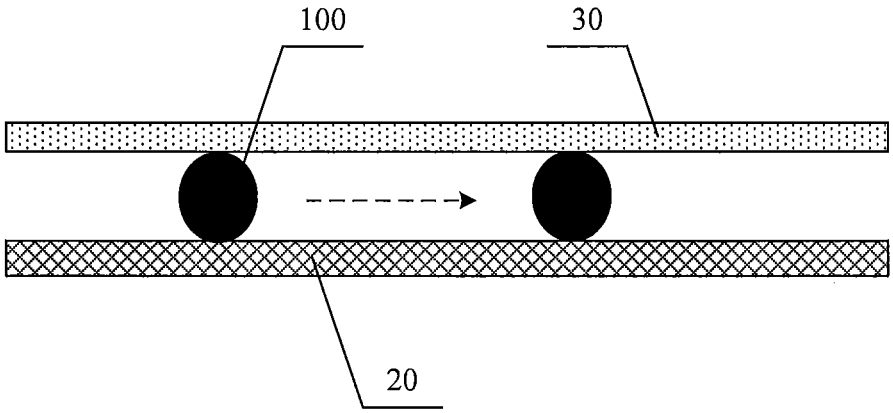
FIG. 4*a* and FIG. 4*b* are schematic views for illustrating a relative position between a light driving layer and a state transition layer in the present disclosure.
Figure 4B:
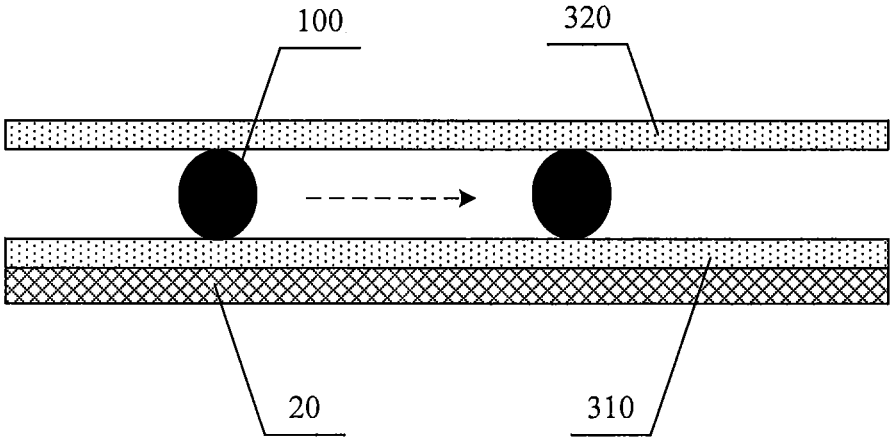

FIG. 4*a* and FIG. 4*b* are schematic views for illustrating a relative position between the light driving layer and the state transition layer in an embodiment of the present disclosure. According to the technical concept in embodiments of the present disclosure, the digital microfluidic chip of the present disclosure can be designed to have various constructions.

As an embodiment, in the construction shown in FIG. 4*a*, the light driving layer 20 and the state transition layer 30 are spaced apart from each other. A space for bearing the droplet 100 is formed between the light driving layer 20 and the state transition layer 30, so that the droplet 100 is accommodated between the light driving layer 20 and the state transition layer 30.

As another embodiment, in the construction shown in FIG. 4*b*, one light driving layer 20 is configured to drive two state transition layers. The state transition layer 30 comprises a first state transition layer 310 and a second state transition layer 320 which are spaced apart from each other. The first state transition layer 310 is arranged on the light driving layer 20, so that the droplet 100 is accommodated between the first state transition layer 310 and the second state transition layer 320. In this embodiment, the droplet 100 is sandwiched between a surface of the first state transition layer 310 away from the light driving layer 20 (an upper surface in the drawing) and a surface of the second state transition layer 320 close to the light driving layer 20 (a lower surface in the drawing), and contact these two surfaces. The digital microfluidic chip of the present embodiment operates in a similar principle with embodiments in FIGS. 1 and 4*a*. The difference from embodiments in FIGS. 1 and 4*a* lies in that, the light driving layer 20 irradiates the first state transition layer 310 and the second state transition layer 320 at a same time, so that an upper surface of the first state transition layer 310 and a lower surface of the second state transition layer 320 that the droplet 100 contact change the lyophilic degree at a same time. Thus, the droplet is subject to the drive force caused by different wetting degrees at both sides, i.e., the upper side and the lower side. This facilitates driving the droplet to move.

In addition, the light driving layer and state transition layer in the stacked structure can directly contact with each other, can be spaced apart by a predefined distance, or can comprise other films therebetween. The present disclosure is not limited in this regard. It is noted that in FIG. 4*a* and FIG. 4*b*, the base plate 10 under the light driving layer 20 is omitted for simplicity.

During implementations, a digital microfluidic chip in an embodiment of the present disclosure further can change the morphology of the droplet. In case the droplet stays static at a certain region, the irradiation intensity of light provided by light emitting units corresponding to this region is by controlled to vary at a predefined rate. The lyophilic degree of this region can be changed, and the droplet may exhibit different solid-liquid contact angles and thus change its morphology. In this case, the state transition layer can comprise a photosensitive material in which a lyophilic trans-structure is capable of transitioning to a lyophobic cis-structure. Upon irradiation, the lyophilic trans-structure in the material is transitioned to the lyophobic cis-structure, so that the surface of the material changes from lyophilic to lyophobic.

According to embodiments of the present disclosure, the novel digital microfluidic chip comprises the light driving layer configured to provide light and the state transition layer which can realize a lyophobicity-lyophobicity transition. The light driving layer provides light to the state transition layer, so as to control the lyophobicity-lyophobicity transition of the state transition layer, which in turn drives the droplet to move. In the existing digital microfluidic chip, the driving voltage is higher than 100V. However, in the light control manner of the present disclosure, there is no need for such a high voltage. A voltage for drive the micro-LED is required, and this voltage is low, so that the power consumption is reduced significantly. In the existing digital microfluidic chip, active substances are subject to irreversible damage. However, in the light control manner of the present disclosure, no current is applied to the droplet, and a strong electric field is not formed. As a result, active substances in the droplet, such as cells, DNA, proteins will not be damaged. Since there no special requirement for the droplet, the light control manner of the present disclosure is applicable to more fields with less limitations. The existing digital microfluidic chip has a multiple-layer structure comprising two substrates which are arranged oppositely. However, in the present embodiment, only one substrate is needed to drive the droplet to move in a certain direction. Besides, the substrate body has a two-layer structure. Thus, the structure is simple, the fabricating process is simple, and the fabricating cost is low. This makes the digital microfluidic chip suitable for mass production with a large area. In addition, by virtue of the fast-growing micro-LED array, it is possible to realize miniaturization and integration to a maximum extent, and it is more easy to realize mass production.

Figure 5A:
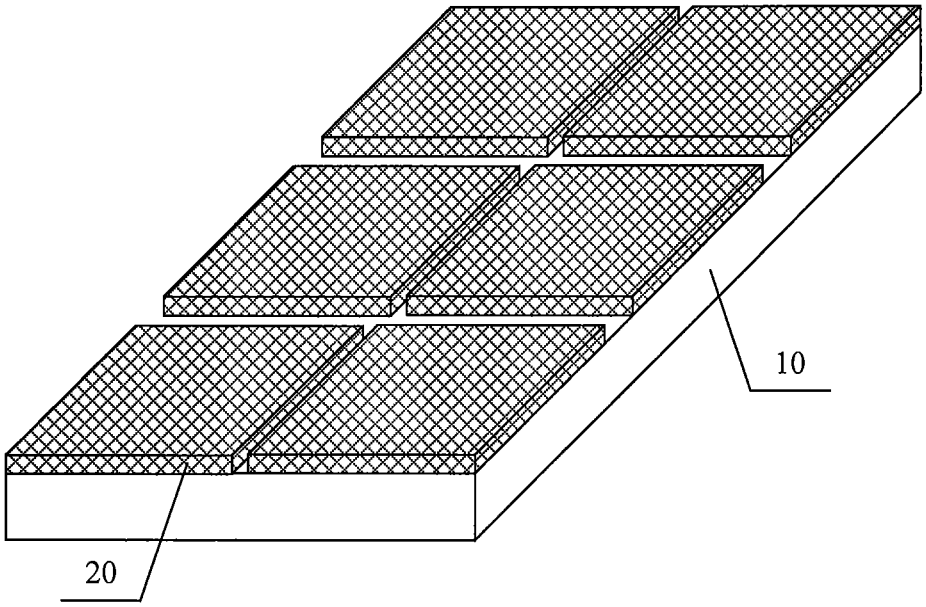
FIG. 5*a* and FIG. 5*b* are schematic views for illustrating a process for manufacturing a digital microfluidic chip in an embodiment of the present disclosure.
Figure 5B:
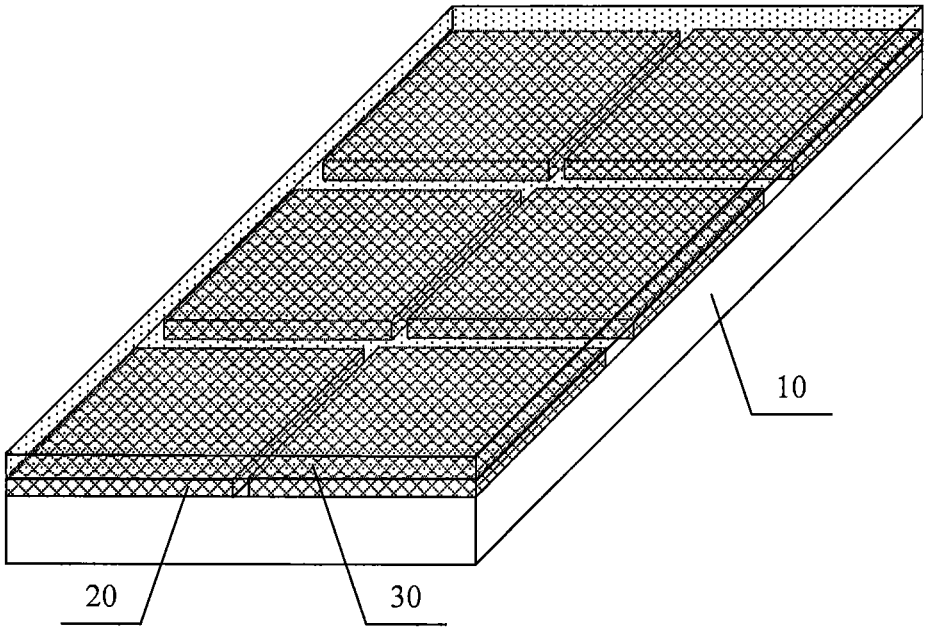

FIG. 5*a* and FIG. 5*b* are schematic views for illustrating a manufacturing process of a digital microfluidic chip in an embodiment of the present disclosure. Firstly, micro-LEDs are formed on the base plate 10 in batches, and the array of micro-LEDs forms constitutes the light driving layer 20. Each of the micro-LEDs can be addressed and controlled to turn on separately, as shown in FIG. 5*a*. Then, a layer of photosensitive organic material is coating on a surface of the light driving layer 20 to form the state transition layer 30, as shown in FIG. 5*b*. Mature processes in the art can be used to fabricate the micro-LEDs and coat the photosensitive organic material, which are not repeated herein for simplicity.

Based on the technical solution as mentioned above, an embodiment of the present disclosure further provides a digital microfluidic device, which comprises the digital microfluidic chip as described above.

Based on the same technical concept, an embodiment of the present disclosure further provides a driving method for a digital microfluidic chip. The digital microfluidic chip comprises a light driving layer, a state transition layer, a detect circuit and a control circuit. The state transition layer is configured to bear the droplet, and comprises a photosensitive material in which a lyophobic cis-structure is transitioned into a lyophilic trans-structure upon irradiation by light. The lyophilic degree of the photosensitive material layer corresponds with the intensity of light provided by the light emitting units. The light driving layer comprises a plurality of light emitting units which are arranged in an array. The light emitting units comprise light-emitting diode.

The driving method for a digital microfluidic chip comprises:

S1, detecting a position of the droplet by using a detect circuit, and sending a position of the droplet to the control circuit;

S2, generating a control signal according to the position of the droplet and a preset movement direction and/or speed of the droplet by using the control circuit, and sending the control signal to the light driving layer, wherein the control signal comprises a position to which light is required to be provided and an intensity of the provided light; and S3, as a response to a control signal, providing light for controlling a lyophobicity-lyophobicity transition of the state transition layer so as to drive the droplet to move by using the light driving layer.

For example, step S2 comprises:

determining first light emitting units from the plurality of light emitting units according to the position of the droplet, determining second light emitting units from the plurality of light emitting units to which light is required to be provided according to the preset movement direction of the droplet, determining the intensity of light provided by the second light emitting units according to the preset movement speed of the droplet, and generating the control signal comprising information about a position of the second light emitting units and information about the intensity of light provided by the second light emitting units.

For example, the digital microfluidic chip further comprises a thermal control layer, and the driving method further comprises: controlling the temperature of the state transition layer by using the thermal control layer.

It is noted that, in the description of embodiments of the present disclosure, orientational or positional relations indicated by "middle", "up", "down", "front", "back", "vertical", "horizontal", "top", "bottom", "inside", "outside" or the like are the orientational or positional relations shown in the figures, and are only for purpose of simplified descriptions for facilitating the description of embodiments of the present disclosure, not for indicating or implying that the described apparatus or elements must have specific orientations. Therefore, they should be construed to limit the present disclosure.

In embodiments of the present disclosure, a digital microfluidic chip, a method for driving the same, and a digital microfluidic device are provided. The digital microfluidic chip includes a state transition layer configured to bear a droplet, and a light driving layer configured to provide light for controlling a lyophobicity-lyophobicity transition of the state transition layer to drive the droplet to move. The light driving layer includes light emitting units arranged in an array and provides light. The state transition layer realizes a lyophobicity-lyophobicity transition. The light driving layer controls the lyophobicity-lyophobicity transition by providing light to drive the droplet to move. An existing digital microfluidic chip has a complex structure and a high fabricating cost, while the digital microfluidic chip of the present disclosure has a simple structure, a simple fabricating process and a low fabricating cost, and can realize miniaturization and integration to a maximum extent.

It is noted that in the description of embodiments of the present disclosure, unless otherwise defined, the terms "installed", "interconnected", or "connected" shall be understood broadly. For example, these terms may mean "connected in a fixed manner", "connected in a detachable manner", or "connected in an integrated manner". These terms may mean "mechanically connected", or "electrically connected". These terms may mean "directly interconnected", "interconnected through a medium", or "communicated inside two elements". As for the person with ordinary skill in the art, the specific meaning of these terms in the present disclosure can be understood in the context.

It will be appreciated that the present invention is not limited to the exact construction that has been described above and illustrated in the accompanying drawings, and that various modifications and changes can be made without departing from the scope thereof. It is intended that the scope of the present invention only be limited by the appended claims.

What is claimed is:

1. A digital microfluidic chip, comprising:

a state transition layer configured to bear a droplet; and a light driving layer configured to provide light for controlling a lyophobicity-lyophobicity transition of the state transition layer to move the droplet.

2. The digital microfluidic chip of claim 1, wherein the state transition layer comprises a photosensitive material in which a lyophobic cis-structure is transitioned into a lyophilic trans-structure upon irradiation by light.

3. The digital microfluidic chip of claim 2, wherein the photosensitive material comprises a copolymer of isopropylacrylamide and acryloxysuccinimide.

4. The digital microfluidic chip of claim 1, further comprising:

a base plate, wherein the light driving layer is on the base plate, and the state transition layer is stacked on the light driving layer.

5. The digital microfluidic chip of claim 4, wherein the droplet is on a surface of the state transition layer away from the base plate.

6. The digital microfluidic chip of claim 4, wherein the light driving layer is spaced apart from the state transition layer, and wherein a space for the droplet is between the light driving layer and the state transition layer.

7. The digital microfluidic chip of claim 4, wherein the state transition layer comprises a first state transition layer and a second state transition layer which are spaced apart from each other, and wherein a space for the droplet is between the first state transition layer and the second state transition layer.

8. The digital microfluidic chip of claim 1, further comprising:

a detect circuit configured to detect a position of the droplet; and a control circuit configured to generate a control signal according to the position of the droplet, a preset movement direction, and speed of the droplet, and send the control signal to the light driving layer, wherein the control signal comprises a position to which light is provided and an intensity of the light.

9. The digital microfluidic chip of claim 8, wherein the light driving layer comprises a plurality of light emitting units, which are arranged in an array.

10. The digital microfluidic chip of claim 9, wherein the control circuit is configured to determine first light emitting units from the plurality of light emitting units according to the position of the droplet, determine second light emitting units from the plurality of light emitting units which provide light according to the preset movement direction of the droplet, and determine the intensity of the light provided by the second light emitting units according to a preset movement speed of the droplet.

11. The digital microfluidic chip of claim 2, wherein the photosensitive material has a lyophilic degree in direct proportion to an intensity of light provided by the light driving layer.

12. The digital microfluidic chip of claim 1, further comprising:

a thermal control layer configured to control a temperature of the state transition layer.

13. The digital microfluidic chip of claim 12, wherein the thermal control layer is between the light driving layer and the state transition layer.

14. The digital microfluidic chip of claim 1, wherein the state transition layer is transitioned from lyophobicity to lyophilicity during the lyophobicity-lyophobicity transition.

15. The digital microfluidic chip of claim 9, wherein each of the plurality of light emitting units comprises a micro-LED.

16. A digital microfluidic device, comprising the digital microfluidic chip of claim 1.

* * * * *